United States Patent [19]

Leech et al.

[11] Patent Number: 4,757,601

[45] Date of Patent: Jul. 19, 1988

[54] CONNECTION OF TAPERED ARMATURE CONDUCTOR TO TAPERED COMMUTATOR SLOT

[75] Inventors: Howard E. Leech; Terry J. Pahls, both of Anderson, Ind.

[73] Assignee: General Motors Corporation, Detroit, Mich.

[21] Appl. No.: 726,656

[22] Filed: Apr. 24, 1985

[51] Int. Cl.[4] ..... H01R 43/04

[52] U.S. Cl. ..... 29/597; 310/42; 310/234

[58] Field of Search ..... 29/597, 598; 310/234, 310/233, 42, 71

[56] References Cited

U.S. PATENT DOCUMENTS

| | | | |
|---|---|---|---|
| 479,179 | 7/1892 | Wightman | 310/234 |
| 495,058 | 4/1893 | Priest . | |
| 514,817 | 2/1894 | Dufault . | |
| 516,827 | 3/1894 | Lieb . | |
| 2,476,795 | 7/1949 | Avigdor | 171/321 |
| 2,572,956 | 10/1951 | Servis | 29/155.54 |
| 3,020,429 | 2/1962 | Courneya | 310/234 |
| 3,156,037 | 11/1964 | Warner | 29/205 |
| 3,161,947 | 12/1964 | Schafer et al. | 29/597 |
| 3,407,491 | 10/1968 | Clevenger et al. | 29/597 |
| 3,421,212 | 1/1969 | Chabot | 29/628 |
| 3,522,462 | 8/1970 | Schwartz | 310/234 |
| 3,665,233 | 5/1972 | Bowcott | 310/234 |
| 3,861,027 | 1/1975 | Allen | 29/597 |
| 4,402,130 | 9/1983 | Tsuruoka et al. | 310/234 X |
| 4,437,230 | 3/1984 | Greutmann | 29/597 |

FOREIGN PATENT DOCUMENTS

| | | |
|---|---|---|
| 2723893 | 12/1977 | Fed. Rep. of Germany . |
| 3148771 | 6/1983 | Fed. Rep. of Germany . |
| 2323263 | 4/1977 | France . |
| 2518841 | 6/1983 | France . |

*Primary Examiner*—Carl E. Hall
*Attorney, Agent, or Firm*—C. R. Meland

[57] ABSTRACT

An armature conductor to commutator bar connection. The bars of the commutator have radially extending slots that are defined by surfaces that taper outwardly. The ends of the armature conductors are formed to a generally wedge-shaped configuration such that the side surfaces are tapered inwardly. After the ends of the armature conductors have been formed to the tapered shape they are pushed into the slots of the commutator bars to such a depth that there is an interference fit between the side surfaces of the ends of the armature conductors and the tapered walls of the slot to lock the ends of the armature conductors to the commutator bars. After the ends of the formed armature conductors have been pushed into the slots, portions of the commutator bars are staked over into engagement with the top armature conductor end.

5 Claims, 2 Drawing Sheets

CONNECTION OF TAPERED ARMATURE CONDUCTOR TO TAPERED COMMUTATOR SLOT

This invention relates to a method of connecting the armature conductors of a dynamoelectric machine armature to the bars or segments of a commutator and to an improved connection between the armature conductors and the commutator bars or segments.

One known method of connecting armature conductors to commutator bars or segments utilizes solder to make the connections. It has been recognized by the prior art, an example being the U.S. Pat. No. to Avigdor 2,476,795, that the use of solder has disadvantages. Thus, the solder during high current and hence high temperature operation may soften or melt to an extent that the solder is thrown out by centrifugal force when the armature and commutator are rotated at high speed, resulting in a failure of the connection. Another disadvantage of soldering is that apparatus must be provided to apply the solder between the internal surfaces of a commutator slot and the surfaces of the armature conductors.

The above-mentioned Avigdor U.S. Pat. No. 2,476,795 and the U.S. Pat. Nos. to Servis 2,572,956 and Tsuruoka et al. 4,402,130 all relate to armature conductor to commutator connections that do not use solder. Thus, in the Avigdor patent the armature conductors are placed in the slots of commutator bars and portions of the bars are clinched into contact with the conductors. In the Servis patent, armature conductors are placed in commutator segment slots and some of the material of the segment is then forced against the upper conductor by a spinning tool. In the Tsuruoka et al. patent, the conductors are placed in a slot of a commutator segment and the conductors are then deformed by impacting the conductors by a punch. After the conductors are deformed portions of the commutator segment are moved into contact with an upper conductor.

It is an object of this invention to provide a method of connecting armature conductors to commutator slots that requires no solder or brazing material and that minimizes the mechanical forces applied to the commutator assembly. Thus, in practicing the method of this invention the end portions of the armature conductors are all formed from a rectangular shape to a generally wedge-shaped configuration having tapered sides by punch and die apparatus prior to being pushed into the slots of commutator bars or segments. The commutator bar slots, that receive the tapered armature conductor ends, have complementary tapered internal walls. After the ends of the armature conductors have been formed to the tapered shape they are all bent or spread outwardly. A commutator assembly is then pushed onto the armature shaft and as the commutator assembly is moved toward the armature the formed tapered armature conductor ends pass through the tapered commutator slots. The formed tapered conductor ends are now pushed into the complementary tapered slots of the commutator bars with an interference fit such that the conductor ends are wedge or taper locked to the commutator bars. Following this, the edges of a commutator slot are staked into engagement with the top conductor end of a formed armature conductor.

It will be apparent, from the foregoing, that mechanical forces required to deform the ends of the armature conductors are applied to the ends of the armature conductors before they are pushed into the commutator slots and hence are not applied to the commutator assembly itself. Moreover, no solder or brazing compound is utilized. In regard to mechanical conductor deforming forces, it is desirable not to subject the commutator assembly to a high deforming force particularly where the commutator is of the so-called molded type where molded plastic material connects an internal metal sleeve and an outer commutator shell. Thus, forces applied to the commutator assembly should be kept low enough so as not to fracture the insulation or otherwise adversely effect the integrity of the commutator assembly.

Another object of this invention is to provide an improved electrical connection between the end of an armature conductor and the internal wall of a slot of a commutator bar wherein the end of the armature conductor has tapered outer surfaces that are in intimate contact with complementary tapered internal surfaces of a commutator slot.

IN THE DRAWINGS

Figure 1:
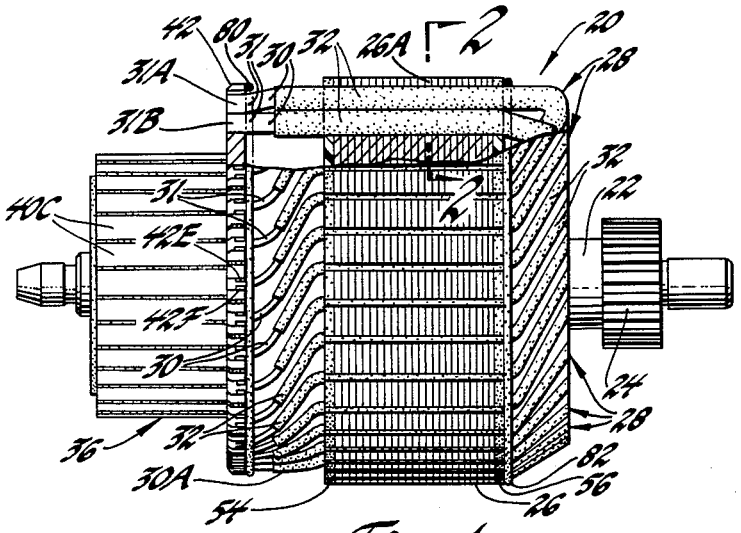
FIG. 1 is a view with parts broken away of an armature assembly made in accordance with this invention.
Figure 2:
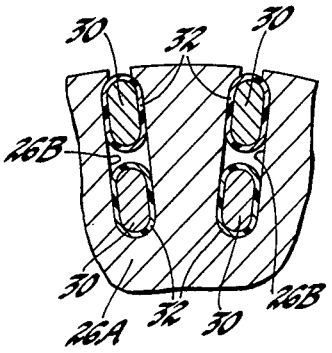
FIG. 2 is a view taken along lines 2—2 of FIG. 1 illustrating a portion of an armature lamination and armature conductors positioned within the slots of the lamination.

Referring now to the drawings and more particularly to FIG. 1, the reference numeral 20 designates an armature assembly for a direct current motor. The armature depicted in FIG. 1 is intended to be used as the armature of a direct current electric starting motor. The armature 20 has an armature shaft 22 which has a gear 24. The shaft 22 carries a stack of steel laminations generally designated by reference numeral 26. The steel laminations are forced onto a knurled portion of the shaft 22 so as to secure the laminations to the shaft 22. One of the laminations that makes up the core 26 is designated by reference numeral 26A and is illustrated in FIG. 2. This lamination, and the other laminations that make up the core 26, have a plurality of circumferentially spaced slots 26B for receiving armature conductors which are inserted into these slots.

Figure 3:
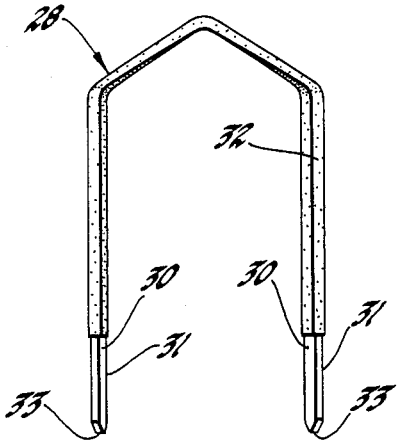
FIG. 3 is a plan view of a winding element or hairpin armature conductor which is inserted into the slots of the core of the armature assembly shown in FIG. 1.
Figure 4:
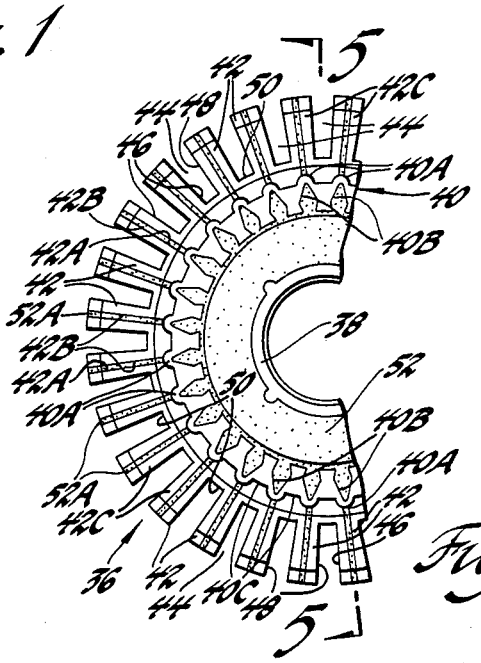
FIG. 4 is an end view of a commutator assembly which forms a component of the armature shown in FIG. 1.
Figure 5:
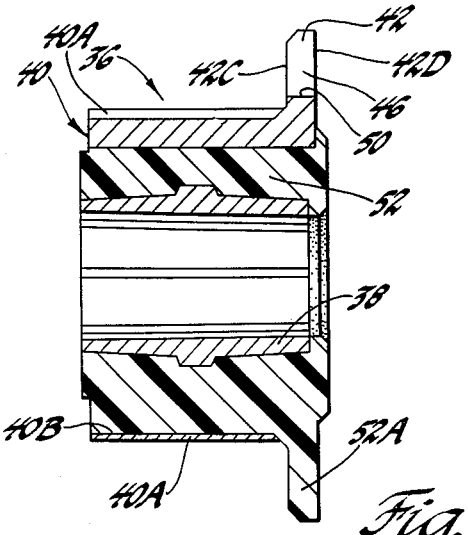
FIG. 5 is a sectional view taken along lines 5—5 of FIG. 4.

The armature winding for armature 20 is composed of a plurality of winding elements which are U-shaped and which are known in the art as hairpin shaped winding conductors. One of these winding elements, or hairpin armature conductors, is illustrated in FIG. 3 and is generally designated by reference numeral 28. The winding element 28 comprises of a copper armature conductor 30 that carries a length of insulating material 32 that encircles the armature conductor 30. The armature conductor 30 has a generally rectangular cross section and has slightly curved or radiused opposed end portions, as is illustrated in FIG. 2. The end portions 31 of the armature conductor 30 are not covered by insulation and they have pointed ends 33 shown in FIG. 3. The pointed ends 33 facilitate the insertion of these ends into the slots of the armature core 26 and into the slots of the commutator riser bars. The ends 31 of the armature conductors 30 are connected to the riser bars 42 of a commutator which is generally designated by reference numeral 36. The commutator 36 is of the molded type and is illustrated in detail in FIGS. 4 and 5. The commutator assembly of FIGS. 4 and 5 is assembled to the shaft 22 of the armature 20 such that the ends 31 of the armature conductors 30 slide through slots in the riser portions of the commutator, all of which will be more fully described hereinafter.

The molded commutator assembly 36, illustrated in FIGS. 4 and 5, will now be described. This commutator assembly comprises a tubular metallic core member 38 and an outer copper tubular shell generally designated by reference numeral 40. The copper tubular part 40 has ribs 40A and a plurality of recesses 40B. The part 40 has a plurality of integral risers, each designated by reference numeral 42. The risers 42 each have a slot 44 that is defined by internal side walls or surfaces 46 and 48 and by a flat inner or bottom wall or surface 50. As will be more fully described hereinafter, the walls or surfaces 46 and 48 are not parallel but taper outwardly by a small amount. Each riser 42 has circumferentially spaced side walls or surfaces 42A and 42B. Further, each riser 42 has a front end face 42C and a rear end face 42D.

The tubular core 38 and the shell 40 are joined by a thermosetting plastic molding material designated by reference numeral 52 which is molded between the two parts in a manner well known to those skilled in the art. The molding material 52 fills the recesses between adjacent riser bar surfaces 42A and 42B to thereby form thin strips of insulation 52A that insulate each riser bar from an adjacent riser bar, as shown in FIG. 4. Moreover, this molding material fills the recesses 40B and the interior of the ribs 40A during the molding operation. When the commutator assembly, shown in FIGS. 4 and 5, has been assembled to an armature and connected to the armature conductors the ribs 40A are machined off so as to provide commutator bar faces 40C that are electrically insulated from each other. The faces 40C are adapted to be engaged by the brushes of a dynamoelectric machine. It is noted that molded commutators, of the type described, are well known to those skilled in the art and one method of manufacturing such a molded type of commutator is disclosed in the U.S. Pat. No. to Clevenger et al. 3,407,491.

The method of connecting the ends 31 of the hairpin conductors 30 to the riser bars 42 of the commutator 36 will now be described. This description will include a brief description of how the armature assembly, shown in FIG. 1, is manufactured prior to the time that the commutator 36 is assembled to the armature shaft 22.

In the manufacture of the armature assembly the laminations that make up the stack of laminations or armature core 26 are pressed onto the armature shaft with the slots in the laminations all being aligned. A pair of insulators 54 and 56, which have slots, are pushed onto the armature shaft with the slots in the insulators being aligned with the slots in the laminated core 26.

When the laminated core and insulators have been assembled to the shaft 22 the winding elements 28 are inserted into the slots in the laminated core. The manner in which the winding elements are inserted is such that one side of a winding element will become an outer or upper conductor and the other side of another winding element will become an inner or lower conductor of a given core slot. The same is true of the ends 31 of the winding elements, that is they will be located such that one of the ends of one winding element is disposed above the other end of another winding element when the winding is completed. The winding is a double layer winding and after all of the winding elements have been inserted into the slots of the laminated core 26 the ends of the winding elements are twisted such that portions 30A of the winding elements extend diagonally, as illustrated in FIG. 1. During this twisting operation the ends 31 are not moved to a diagonal position but rather extend axially of the shaft 22 and substantially parallel to the shaft 22.

Figure 10:
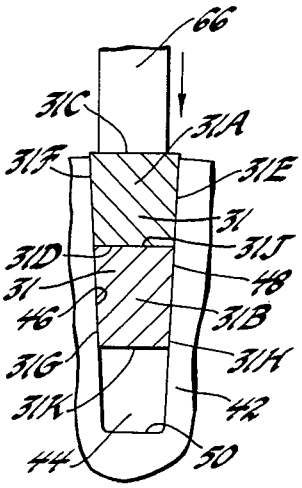
FIG. 10 illustrates apparatus for pushing the formed armature conductors down into a slot of a commutator riser bar.

When an armature assembly has been fabricated, in a manner that has been described, that is with the conductor end portions 31 all extending parallel to the armature shaft, the end portions 31 of the armature conductors 30 are all formed into the shape illustrated in FIG. 10, where a formed upper armature conductor end portion has been designated as 31A and a lower formed armature conductor end portion has been designated as 31B. FIG. 10 will be described in detail hereinafter and FIG. 10 illustrates a riser bar 42 having the outwardly tapered inner flat slot surfaces 46 and 48 and the lower or bottom internal flat surface 50. The formed conductor end portion 31A corresponds to a formed end portion of an armature conductor portion 31 and it has parallel flat planar surfaces 31C and 31D and outwardly tapered flat planar surfaces 31E and 31F. In a similar fashion, the formed armature conductor end portion 31B, which corresponds to a formed part of armature conductor end portion 31, has outwardly tapered flat surfaces 31G and 31H and parallel upper and lower flat surfaces 31J and 31K.

Figure 6:
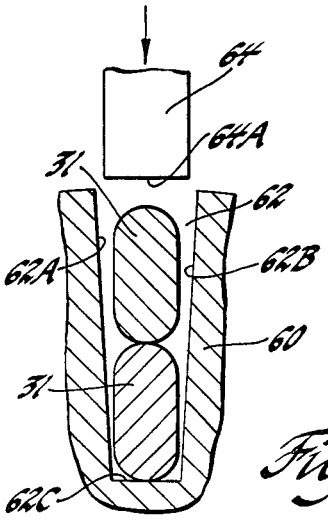
FIG. 6 illustrates punch and die apparatus for forming armature conductors to a generally wedge-shaped cross section.

The formed conductor end portions 31A and 31B are formed to the tapered configuration illustrated in FIG. 10 by the punch and die apparatus illustrated in FIG. 6. Thus, a pair of armature conductor ends 31 which are generally rectangular, as illustrated in FIGS. 2 and 6, are located within a die 60 which has a die cavity 62 that is comprised of outwardly tapered flat surfaces 62A and 62B and a lower inner flat surface 62C. The taper of the walls 62A and 62B corresponds to the taper of the internal surfaces 46 and 48 of a commutator riser 42, which will be more fully described hereinafter. With the armature conductor ends 31 positioned in the die cavity 62, as illustrated in FIG. 6, a radially movable punch 64 is moved down into the die cavity to cold form the conductor ends 31 from their rectangular cross section, illustrated in FIG. 6, to the wedge-shaped or tapered cross section or configuration illustrated in FIG. 10.

In regard to the taper angle of the surfaces 62A and 62B, which corresponds to the taper angle of the internal slot surfaces 46 and 48 of the riser 42, it is pointed out that the taper of surfaces 46 and 48 can be approximately 3°. Thus, the angle between a pair of lines, which intersect the center of the commutator 36 where one of the line bisects the riser slot 44 and the other line coincides with one of the riser slot surfaces 48, will be approximately 3°. This means that the included angle between surfaces 46 and 48 will be approximately 6°. In FIG. 10 the formed conductors 31A and 31B are shown in the position where they have been pushed into the slot 44 by a push-in blade 66 and where they just make contact with surfaces 46 and 48. The die cavity 62 is substantially a mirror image or counterpart of the riser slot 44 from a line corresponding to lower surface 31K of conductor end 31B to the open end of the slot 44, as these parts are viewed in FIG. 10. The surface 31C of conductor end 31A is formed by the flat face 64A of punch 64 and the surface 31K of formed conductor end 31B corresponds to die cavity surface 62C.

The die cavity 62 extends for about the same axial length as the length of a conductor end portion 31 and is open on both ends. The axial length of punch 64 can be about the same length as the length of die cavity 62. It is preferred that the die 60 have a plurality of circumferentially spaced die cavities 62 corresponding to the number of pairs of armature conductor ends so that all of the conductor ends can be simultaneously inserted into the die 60. The number of punches 64 will also correspond to the number of pairs of conductor ends so that all of the conductor ends 31 are simultaneously cold formed to the configuration illustrated in FIG. 10.

Figure 7:
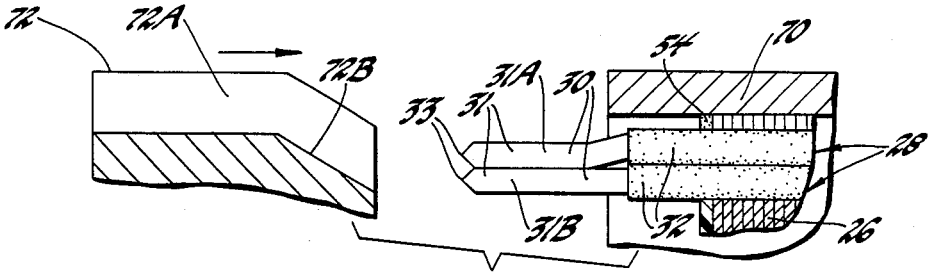
FIG. 7 illustrates apparatus for spreading or bending armature conductors outwardly.

When the conductor end portions have all been preformed, in a manner that has been described, they will extend substantially parallel to the longitudinal axis of the shaft 22. In order that the formed conductor ends 31A and 31B will have sufficient clearance with the internal surfaces of the slots 44 so that they can pass through the slots 44 of risers 42, when the commutator 36 is axially assembled to the shaft 22, it is necessary that the conductor ends be spread or bent from the position illustrated in FIG. 7 to the position illustrated in FIGS. 8 and 9. In FIG. 7 the formed conductor ends have been designated as 31A and 31B. In order to bend these conductor ends simultaneously outwardly away from the armature shaft a metallic armature conductor retaining tube 70 is slipped over the armature and the armature conductors to the position illustrated in FIG. 7. A forming or spreading tool, designated by reference numeral 72, is then moved toward the conductor ends 31A and 31B. This forming tool has a plurality of slots 72A corresponding in number to the pairs of conductor ends. The inner surface of the slots 72A each have an inclined surface 72B. When the forming tool 72 is moved toward the conductors 31A and 31B the surfaces 72B engage the lower wall of conductor ends 31B and the conductor ends 31A and 31B are then bent outwardly to the position illustrated in FIG. 8. An inner edge of the tube 70 operates as a fulcrum during this bending or spreading operation. It is to be understood that all of the conductor ends of the entire armature winding are simultaneously bent or spread outwardly.

Figure 8:
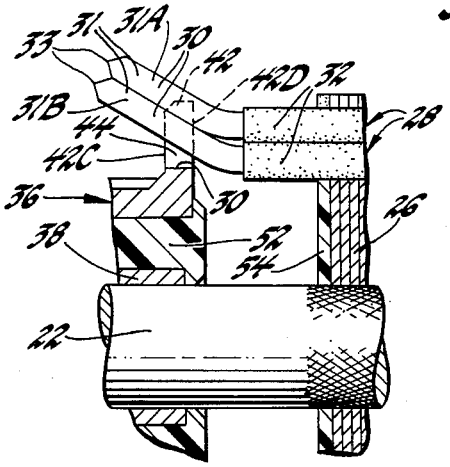
FIG. 8 illustrates one of the riser bars of the commutator shown in FIG. 1 and the position of formed armature conductors relative to the slot in the riser bar when the commutator is assembled to the armature shaft and moved such that the ends of the formed armature conductors pass through the riser bar slots.
Figure 9:
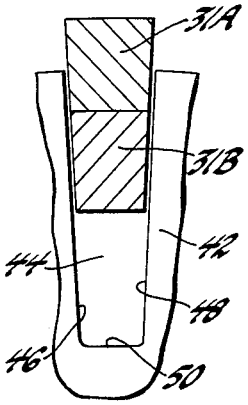
FIG. 9 is a view illustrating the relative position of the formed armature conductors and the slot in a riser bar at the time that the commutator assembly has been assembled to the armature shaft.

After the armature conductors have been spread or bent outwardly the commutator assembly 36 is assembled to the shaft 22 by pushing the commutator assembly onto the shaft such that the metallic sleeve 38 engages the outer surface of the shaft. As the commutator assembly is pushed onto the shaft the formed and outwardly spread or bent conductor ends 31A and 31B will pass through the respective slots 44 in the risers 42. The commutator is so rotatably oriented relative to the shaft that the conductor pairs 31A and 31B are aligned with the slots 44. It can be seen, from FIG. 9, that due to the fact that the conductor ends 31A and 31B have been bent outwardly there is clearance between the outer surfaces of conductor ends 31A and 31B and the internal surfaces of the slot 44. It also can be seen, from FIGS. 8 and 9, that a portion of conductor end 31B is located entirely within slot 44 whereas portion of the lower part of conductor portion 31A is located within the upper end of the slot 44. The final axially assembled position of the commutator 36 is illustrated in FIGS. 8 and 9. It can be seen from FIG. 8 that the formed conductor ends 31A and 31B extend through a slot 44 and the pointed ends 33 are located to the left of riser faces 42C.

When the commutator has been pushed onto the shaft to its final assembled position, and with portions of the conductor ends 31A and 31B located within the riser slots, the conductor ends 31A and 31B are pushed into a riser slot. This is accomplished by a radially movable push-in blade 66, illustrated in FIG. 10. The front to back length of this blade is about the same as the axial length of a slot 44. As the blade 66 is moved radially inwardly it will engage the top surface 31C of conductor end 31A and will push the conductor ends 31A and 31B from the FIG. 9 position to the FIG. 10 position. The FIG. 10 position of conductor ends 31A and 31B is a position in which the tapered surfaces 31F and 31G and 31E and 31H just make contact respectively with the tapered internal surfaces 46 and 48 of the slot 44.

Figure 11:
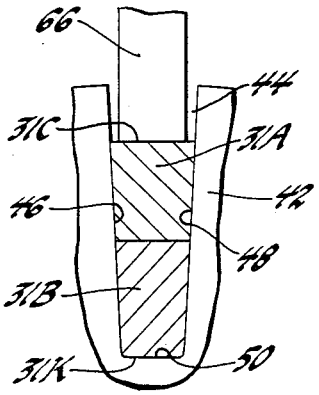
FIG. 11 illustrates the position of the formed armature conductors when they have been pushed completely into a slot of a commutator riser bar.

As the push-in blade 66 continues to move inwardly it will force the tapered conductor ends 31A and 31B from the FIG. 10 position to the FIG. 11 position in which the lower face 31K of conductor end 31B has bottomed out on the lower flat surface 50 of the slot 44. As the conductor ends 31A and 31B are moved from the FIG. 10 position to the FIG. 11 position the rubbing or scrubbing contact between the tapered surfaces of the conductor ends and the tapered internal surfaces of the slot 44 provide a scrubbing action which cleans any oxidation or other material from the surfaces. This provides bright-shiny, clean surfaces. When the conductor ends are moved from the FIG. 10 position to the FIG. 11 position they have an interference fit with the internal tapered surfaces of the riser slot 44. As a result, when the conductor ends have been moved to the FIG. 11 position there is an interference fit between the tapered sides of the conductor ends and the tapered internal surfaces of the riser slot which wedge or taper locks the conductors to the internal walls of the riser slot. In other words, the conductor ends 31A and 31B are now locked to the riser bars 42. The apparatus for pushing conductor ends 31A and 31B into the respective riser slots preferably includes a plurality of push-in blades 66 equal in number to the number of pairs of formed conductor ends so that all of the conductor ends are simultaneously pushed into all of the riser slots of the commutator.

Figure 12:
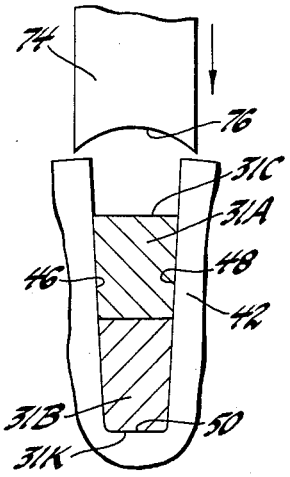
FIG. 12 illustrates apparatus for staking over a portion of the riser bar into engagement with the top conductor of a pair of formed armature conductors that have been pushed into the slot of a commutator riser bar.
Figure 13:
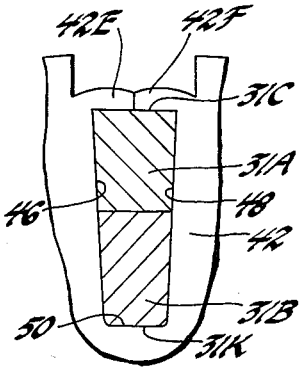
FIG. 13 illustrates portions of the riser bar staked into engagement with the top formed conductor of a pair of conductors positioned within a slot of a commutator riser bar.

When the conductor ends have all been pushed into the riser slots, portions of the risers adjacent the slots are staked into engagement with the surface 31C of formed conductor end 31A. This is accomplished by apparatus, which is illustrated in FIG. 12, that includes a radially movable staking tool 74 that has a curved end 76. When the staking tool 74 is moved toward a riser 42 it strips or peels portions 42E and 42F from the riser portion 42 and moves these portions into engagement with the surface 31C of formed conductor 31A, as illustrated in FIG. 13. The axial length of staking blade 74 can be such that it does not stake over the entire axial length of a riser bar between surfaces or end faces 42C and 42D. Thus, one edge of the staking tool 74 can be spaced inwardly slightly from the surface 42C during the staking operation so that a radial wall, that includes surface 42C of about 0.2 mm thick, is not staked over. The staking tool may also be of such a length that a radial wall of a thickness less than 0.2 mm, that includes surface 42D, is not staked over. In general, the staking tool stakes over substantially the entire length of a riser bar. The reason for not staking over the entire length of a riser bar is that the force required for the staking operation is reduced. If desired, the entire length of the riser bar may be staked over. In the final formed condition of FIG. 13, virtually all exposed sides of the conductor end portions 31A and 31B are tightly engaged by the material of the copper riser 42 so that there is intimate electrical contact between the surfaces of the formed conductor ends 31A and 31B and the internal surfaces of slot 44 and between surface 31C and the internal surfaces of staked over portions 42E and 42F. It is preferred that a plurality of staking blades 74 be provided that are equal in number to the number of riser slots of the commutator. The staking blades 74 are suitably supported for radial movement by apparatus, which has not been illustrated, and the staking blades are all moved simultaneously inwardly to thereby simultaneously stake all of the risers.

When all of the conductor ends have been connected to the commutator, in a manner that has been described, the commutator is machined off to remove the ribs 40A to provide a smooth outside surface for the commutator. In addition the portions of conductor ends 31A and 31B, that extend beyond the faces 42C of the riser bars, is machined off.

The armature assembly preferably includes banding for retaining the armature conductors in the slots against the effects of centrifugal force. This banding comprises, for example, three turns of glass roving which is impregnated with a suitable material such as an epoxy resin. This roving has been identified by reference numerals 80 and 82 in FIG. 1. The three turn band 80 is disposed closely adjacent the inside faces 42D of the riser bars and engages the armature conductors at this point. The other three turn band 82 is located adjacent the insulator 56 and also engages the outer periphery of the armature conductors.

At the expense of some reiteration, the following sets forth the sequence of process steps that are utilized to connect the armature conductors to the commutator slots.

1. The ends of the armature conductors are formed into a wedge-shaped or tapered configuration by the punch and die apparatus illustrated in FIG. 6.
2. The formed ends of the armature conductors are spread or bent outwardly.
3. A commutator is assembled to the armature shaft and as it is pushed onto the armature shaft to its final assembled position, the outwardly bent and formed conductor ends pass through the slots in the risers.
4. The formed armature conductor ends are pushed into the slots.
5. The top edges of the riser slots are staked into engagement with the top armature conductor.
6. The portions of the armature conductors, that extend beyond one edge of the risers is machined off as well as the outer faces of the risers.

By way of example, and not by way of limitation, the following are dimensions (millimeters) of the formed armature conductor end portions and the risers and riser slots that can be used in practicing this invention where the sides of the formed armature conductor end portions and riser slot surfaces 46 and 48 have a 3° taper.

| | |
|---|---|
| Surface 31C | 2.75 mm |
| Surface 31D | 2.47 mm |
| Surface 31C to Surface 31D | 2.75 mm |
| Surface 31J | 2.47 mm |
| Surface 31K | 2.15 mm |
| Surface 31J to Surface 31K | 3.01 mm |
| Riser slot surface 50 | 1.88 mm |
| Width of open end of riser slot 44 | 2.76 mm |
| Axial length of riser slot 44 | 3.81 mm |
| Total radial depth of riser slot 44 | 8.29 mm |
| Radius of commutator (Center to outer surface of riser) | 31.10 mm |

In addition to the foregoing, the dimension between the internal slot surfaces 46 and 48 and respective side surfaces 42A and 42B of a riser is about 1.77 mm when measured at the outer circumference of the risers.

When the armature conductor ends 31A and 31B are in their bent out or spread out positions, shown in FIGS. 8 and 9, there will be a clearance of about 0.075 mm between the tapered sides of the armature conductor ends and tapered internal surfaces 46 and 48 of a riser slot 44. This clearance is sufficient to allow the formed armature conductor ends to pass through the riser slots when the commutator is pushed onto the armature shaft.

As previously mentioned, FIG. 10 illustrates the position of the formed armature conductor ends where they have been pushed into a riser slot to such a depth that the tapered side walls of the armature conductor ends just come into contact with the complementary tapered internal riser slot surfaces 46 and 48. When the armature conductor ends are pushed all the way into a riser slot, as illustrated in FIG. 11, there is an interference fit between the sides of the armature conductor ends and riser slot internal surfaces 46 and 48 of about 0.14 mm (0.005 inches) at each side of the armature conductor ends.

At the expense of some reiteration, it is noted that when the formed armature conductor ends 31A and 31B are moved from the FIG. 9 position to the FIG. 11 position a scrubbing action will begin to occur between the side surfaces of the armature conductors and riser slot surfaces 46 and 48 as soon as these surfaces become engaged, as illustrated in FIG. 10. As the armature conductors are moved from the FIG. 10 position to the bottomed-out FIG. 11 position the tapered side surfaces of the armature conductor ends are scrubbed against the tapered internal riser slot surfaces 46 and 48. The radial length of movement of the armature conductors, from the FIG. 10 to the FIG. 11 position, can be about 2.55 mm when using the previously described dimensions and the scrubbing action takes place during the entire length of this movement. This scrubbing action of the engaged surfaces causes the surfaces to be wiped clean with the result that there is a good intimate copper-to-copper electrical connection between the surfaces of the armature conductor ends and the internal surfaces that define the riser slot. This scrubbing action will wipe off any oxidation and the contacting surfaces become bright and shiny due to the scrubbing action.

When the armature conductors have been moved to the FIG. 11 position, the tapered side surfaces of the armature conductor ends are fixed or locked to the tapered internal riser slot surfaces 46 and 48. This is due to the interference fit between the parts. Putting it another way, the armature conductor ends are wedged into the tapered riser slots so that parts are locked together in what may be termed a taper-lock connection. The interference fit begins at the FIG. 10 position of the armature conductor ends and the amount of interference progressively increases as the armature conductor ends are moved from the FIG. 10 position to the FIG. 11 position.

After the risers have been staked, as illustrated in FIG. 13, and the ends of the armature conductors and the riser faces have been machined off, the line joining the outer surfaces of the armature conductor ends and the internal surfaces of the riser slots is virtually imperceptible to the naked eye. Further, the surfaces 31D and 31J are tightly engaged so that a line representing these engaged surfaces is virtually imperceptible. Thus, after final machining, the end faces of the risers appear as solid planar substantially unbroken copper surfaces.

In the description of this invention, it has been pointed out that the formed armature conductors are pushed entirely into the riser slots, as illustrated in FIG. 11, such that conductor surface 31K bottoms-out against riser slot surface 50. It is not necessary, in practicing this invention, that the surface 31K be pushed against surface 50. Thus, the armature conductors may be pushed into a slot to such a depth that there would be some clearance between surface 31K and surface 50 as long as the dimensions of the parts and the taper of the engaged surfaces are such that a scrubbing action will occur and such that there is ultimately an interference fit between the parts.

If the depth of the riser slot is made long enough and if the armature conductors are pushed into the slot to such a depth that the lower surface 31K has some clearance with slot surface 50 it is believed that some cold welding will be experienced between the engaged surfaces.

In the description of this invention a commutator of the so-called molded type has been described. The connecting method of this invention is applicable to commutators that are not of the molded type, for example a type of commutator that uses copper segments and V-rings with separate strips of insulation between the segments.

In the description of this invention it was pointed out that the riser slot surfaces and the side surfaces of the armature conductors have a taper of 3°. The amount of taper may vary within limits and may be, for example 2°. The included angle, where a 2° taper is used, would of course be 4°. The taper angle is limited by the width of a riser and should not be so large as to lose the scrubbing action or the ability of the armature conductors to be fixed or locked to the riser when it is pushed into the riser slot.

When all of the armature conductors have been connected to the commutator the armature can be rolled in a liquid varnish which subsequently dries or cures to thereby impregnate the armature with varnish. Following this, the commutator can be subjected to a final machining operation.

It is pointed out that the connecting method of this invention does not utilize hot staking of a type wherein current carrying electrodes engage a commutator bar and cause current to flow through a portion of the riser and conductor to heat these parts to a temperature that softens the parts to a condition where they can be deformed or staked by one of the current carrying electrodes. By not using hot staking or any other form of applied heat this invention has the advantage of not subjecting the commutator to high temperature. Further, by not using hot staking this invention eliminates the need for current carrying electrodes and the power supply for these electrodes and other apparatus that is required when hot staking is employed.

The embodiments of the invention in which an exclusive property or privilege is claimed are defined as follows:

1. A method of connecting the ends of upper and lower armature conductors to a commutator bar, the steps comprising, forming portions of the ends of said upper and lower armature conductors into a generally wedged-shaped configuration such that respective, opposed side surfaces of the formed conductor portions of both armature conductors are aligned and tapered radially inwardly at the same angle, then positioning a commutator bar that has a slot that is defined by a bottom surface and opposed internal tapered surfaces that are complementary to the tapered surfaces of the formed conductor portions such that the open end of the slot is aligned with the formed conductor portions, forcing the formed conductor portions into the slot to such a depth that a lower surface of the formed conductor portion of said lower conductor engages said bottom surface of said slot and to such a depth that there is an interference fit between the tapered surfaces of the formed conductor portions and the internal tapered surfaces of the slot whereby the formed conductor portions are taper locked to the internal walls of the slot, and then staking portions of the commutator bar located adjacent the outer end of the slot into engagement with the formed conductor portion of said upper conductor.

2. A method of connecting the ends of a pair of armature conductors to a commutator bar, the steps comprising, forming a portion of the end of each armature conductor into a generally wedged-shaped configuration such that respective, opposed side surfaces of the formed conductor portion of each armature conductor are aligned and tapered radially inwardly at the same angle, then positioning a commutator bar that has a slot that is defined by opposed internal tapered surfaces that are complementary to the tapered surfaces of the formed armature conductor portions such that one of said formed conductor portions is disposed entirely within said slot and the other formed conductor portion is disposed at least partially within said slot, forcing the formed conductor portions into the slot to such a depth that there is an interference fit between the tapered surfaces of the formed conductor portions and the internal tapered surfaces of the slot whereby the formed conductor portions are taper locked to the internal walls of the slot, and then staking portions of the commutator bar located adjacent the outer end of the slot into engagement with one of the formed conductor portions.

3. A method of connecting upper and lower armature conductors to a commutator bar of a commutator of a dynamoelectric machine, the steps comprising, simultaneously forming portions of the ends of said upper and lower conductors to a generally wedged-shaped configuration such that respective opposed side surfaces of both conductor portions are aligned and the conductor portions are tapered radially inwardly relative to the axis of the commutator, then positioning a commutator bar that has a slot that is defined by opposed internal tapered surfaces that are complementary to the tapered surfaces of the formed armature conductor portions such that a length of the formed conductor portion of said lower conductor is disposed entirely within said slot and a length of the formed conductor portion of said upper conductor is disposed at least partially within said slot, simultaneously pushing the formed conductor portions of said upper and lower conductors into the slot to such a depth that there is an interference fit between the tapered surfaces of the formed conductor portions and the internal tapered surfaces of the slot whereby the formed conductor portions of said upper and lower conductors are locked to the internal walls of the slot, and then staking portions of the commutator bar located adjacent the outer end of the slot into engagement with the formed conductor portion of said upper conductor.

4. A method of connecting the end of an armature conductor of an armature of a dynamoelectric machine that has an armature shaft and an armature core that carries the armature conductor to a commutator bar of a commutator that is carried by the shaft, wherein an end portion of the armature conductor has a generally wedged-shaped configuration such that the opposed side surfaces of the end portion of the armature conductor are tapered inwardly and wherein the bar of the commutator has a radially extending slot that has opposed internal side surfaces which taper outwardly, the tapered side surfaces of said end portion of said armature conductor and the internal surfaces of said slot having an interference fit when an end portion of an armature conductor is pushed into said slot by a predetermined amount, the steps comprising, bending the end portion of the armature conductor away from the shaft by an amount that will provide clearance between outer surfaces of said end portion of said armature conductor and the internal surfaces of said slot when a commutator is assembled to said shaft and axially moved to cause the end portion of said armature conductor to pass through said slot during said axial movement, assembling a commutator to said shaft and moving it axially relative to said shaft to a position wherein the end portion of said armature conductor projects through said slot, pushing the end portion of the armature conductor into said slot to such a depth that there is an interference fit between the tapered surfaces of the end portion of the armature conductor and the internal tapered surfaces of the slot, and then moving a portion of the commutator bar adjacent the slot into engagement with the end portion of said armature conductor.

5. A method of connecting the ends of the armature conductors of an armature of a dynamoelectric machine that has an armature shaft and an armature core that carries the armature conductors to the bars of a commutator, the steps comprising, forming the ends of the armature conductors into a generally wedged-shaped configuration such that the side surfaces of the armature conductor end portions taper inwardly, bending the said formed armature conductor end portions radially outwardly away from said shaft, assembling a commutator to said armature shaft that has a plurality of commutator bars each of which has a slot defined by internal side surfaces that taper outwardly, the tapered side surfaces of the slot being complementary to the tapered side surfaces of the formed end portions of the armature conductors, during assembly of said commutator to said shaft sliding the commutator axially relative to said shaft such that said formed end portions of said armature conductors pass though said slots in said commutator bars whereby lengths of said formed end portions of said armature conductors are located in said slots, pushing the formed end portions of said armature conductors radially into said slots of said commutator bars to such a depth that said tapered surfaces of said formed end portions of said armature conductors have an interference fit with the tapered internal surfaces of said slots, and then moving portions of said commutator bars located adjacent the outer ends of said slots into engagement with the formed end portions of said armature conductors.

* * * * *